United States Patent [19]

Berger

[11] 4,022,221

[45] May 10, 1977

[54] TOBACCO SMOKE FILTER

[75] Inventor: Richard M. Berger, Richmond, Va.

[73] Assignee: American Filtrona Corporation, Richmond, Va.

[22] Filed: Oct. 31, 1975

[21] Appl. No.: 627,858

[52] U.S. Cl. ..... 131/10.5; 131/261 B

[51] Int. Cl.[2] ..... A24D 1/04

[58] Field of Search ..... 131/10.5, 261 B, 10.7, 131/10 A, 10 R, 264, 265–269, 10.9, 201, 261 R, 202

[56] References Cited

UNITED STATES PATENTS

| | | | |
|---|---|---|---|
| 3,336,928 | 8/1967 | Morehouse | 131/10.5 |
| 3,533,416 | 10/1970 | Berger et al. | 131/10.5 X |
| 3,752,165 | 8/1973 | Harllee et al. | 131/261 B |
| 3,768,489 | 10/1973 | Kiefer et al. | 131/261 B |
| 3,805,801 | 4/1974 | Berger et al. | 131/10.5 |
| 3,888,160 | 6/1975 | Westcott et al. | 131/261 B |

FOREIGN PATENTS OR APPLICATIONS

| | | | |
|---|---|---|---|
| 1,341,077 | 12/1973 | United Kingdom | 131/261 B |

*Primary Examiner*—John F. Pitrelli

[57] ABSTRACT

Tobacco smoke filters wherein the products have both internal and external cavities, with the external cavities being of a limited nature so as to provide a substantially smooth outer surface for attaching conventional plug wrap without the need for an internal glue line. The external cavities comprise from about 5 to no more than 50 percent of the total outer surface of the inner filter member, preferably between about 20 to 30 percent. This enables the inner filter member to provide substantially uniform support to the overwrap. The outer cavities may be in the form of elongated, discrete, grooves, a knurled-like pattern or a continuous helical groove. The resultant filter has high filtration and correspondingly low pressure drop characteristics, with the technique of manufacture being such as to permit higher production speeds than with the prior art, resulting in lower manufacturing costs.

15 Claims, 20 Drawing Figures

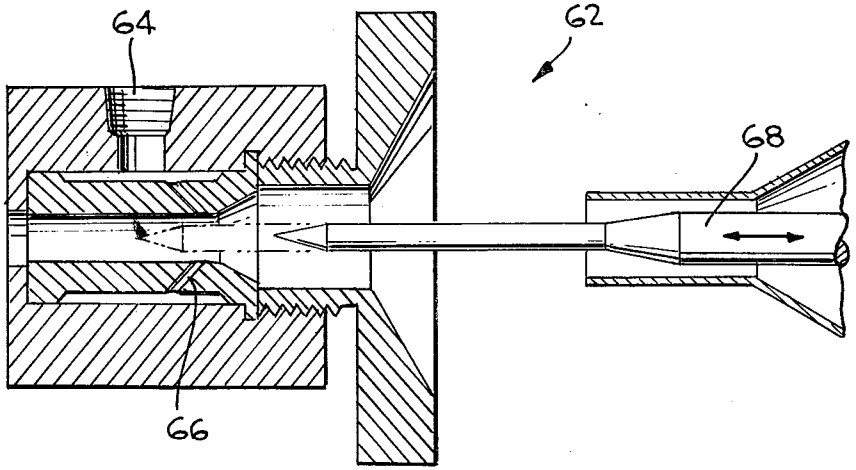
FIG. 10
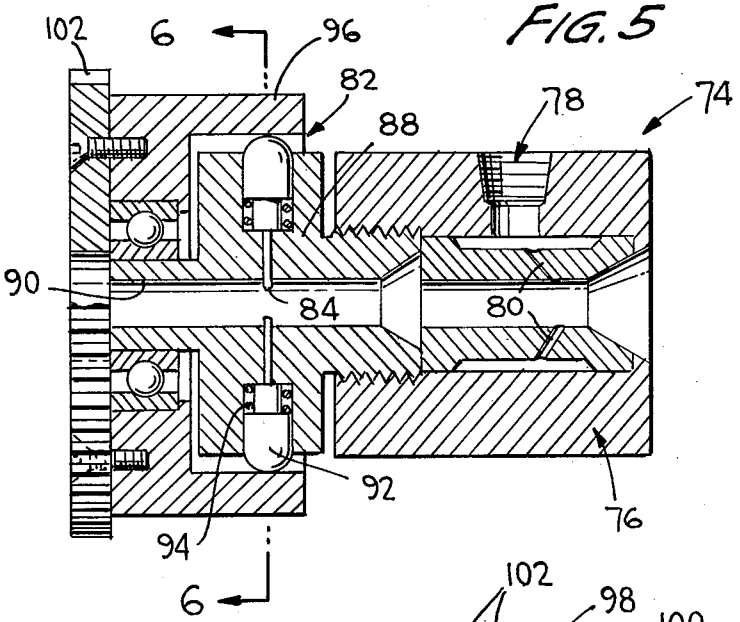
FIG. 5
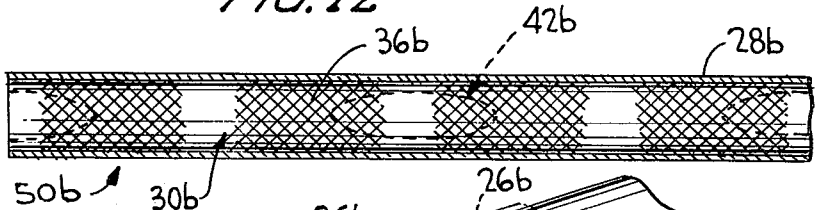
FIG. 12
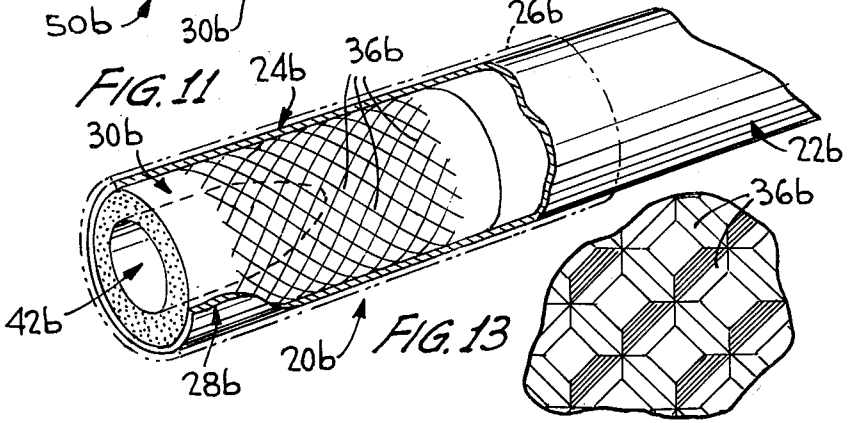
FIG. 11
FIG. 13
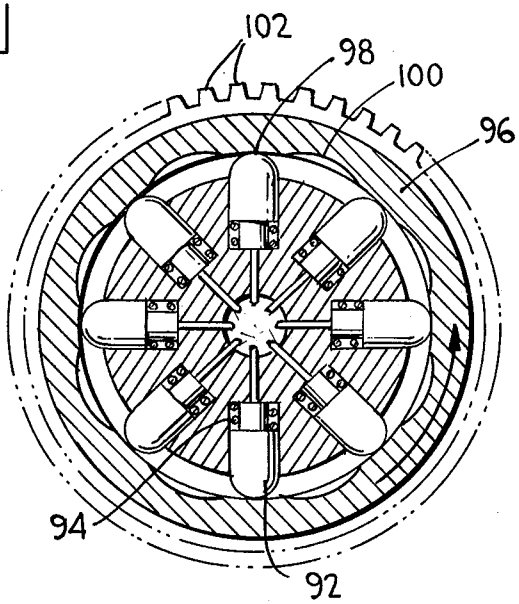
FIG. 6

FIG. 19
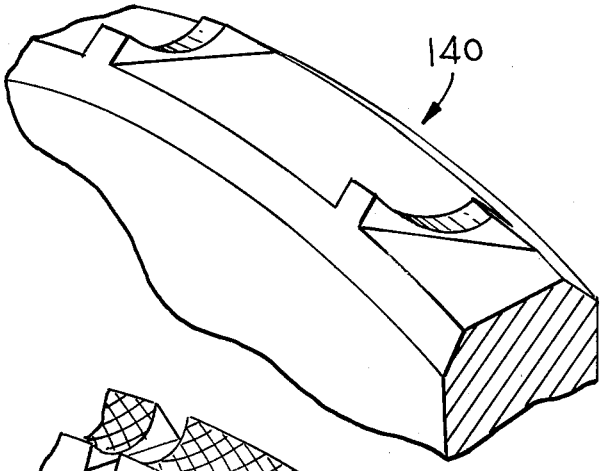
FIG. 17
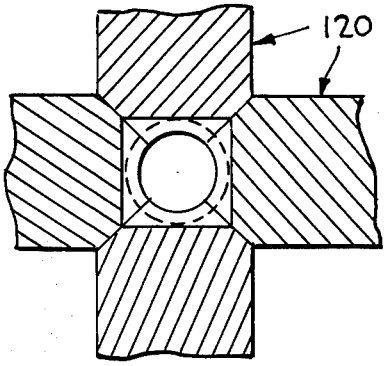
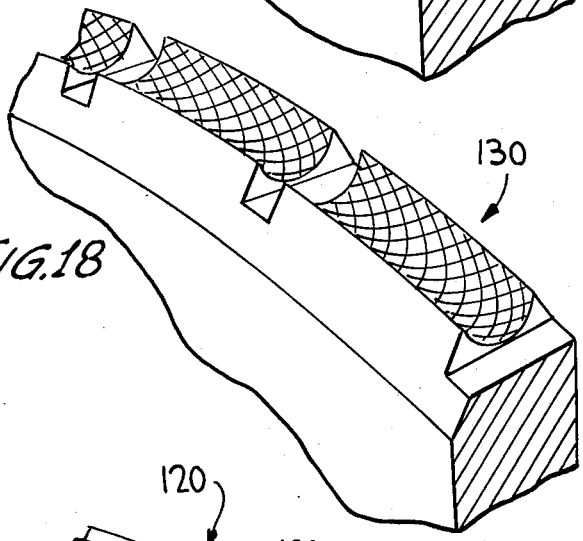
FIG. 18
FIG. 20
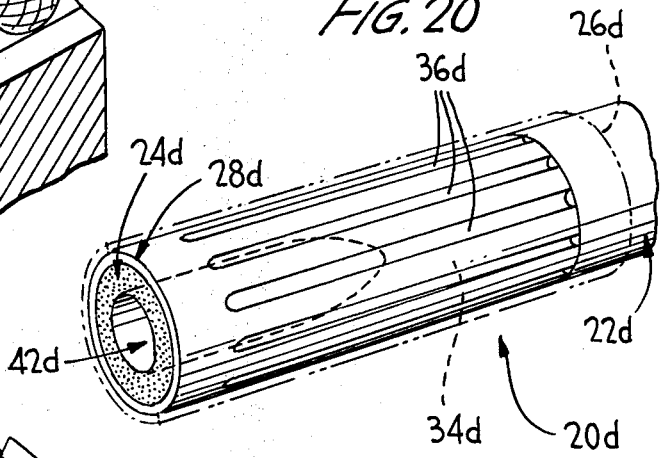
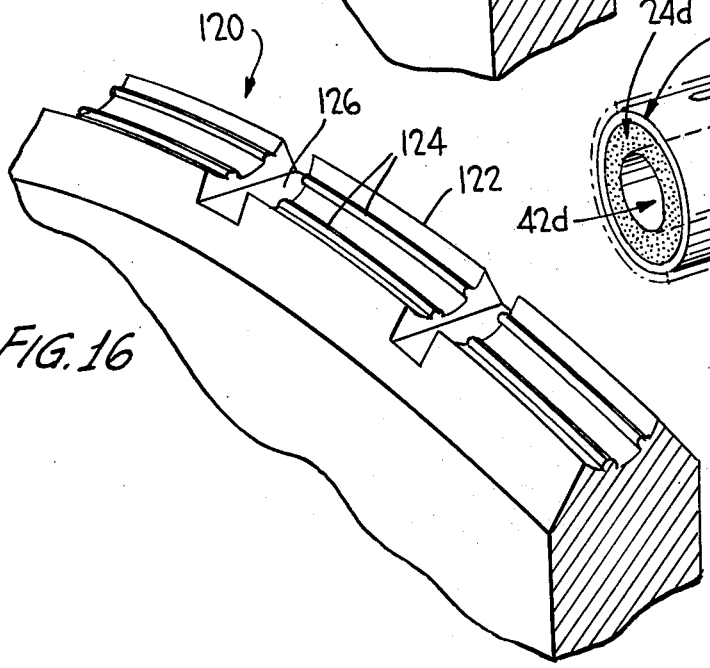
FIG. 16

TOBACCO SMOKE FILTER

This invention relates to the production of filter means, and relates more particularly to tobacco smoke filter elements. More specifically, the instant inventive concepts are primarily concerned with producing filter means for cigarettes, although the products of this invention are generally useful as filters, particularly for tobacco smoking means, whether they be cigarettes, cigars, pipes or the like Since filters for cigarettes are particularly commercially important, the basic embodiments of the instant invention will be discussed as they relate to the production of filtered cigarettes.

Various prior art techniques are known for making filters for use in connection with cigarettes and the like, although the resultant products, in general, have one or more disadvantages. Perhaps the most important property of a filter means is its efficiency, that is, its ability to remove undesirable constituents from tobacco smoke. Filtration efficiency is ordinarily measured in terms of the percentage of total particulate matter (TPM) removed from the smoke, although there is also some concern for the percentage of gas phase constituents which a filter means is capable of removing. While filtration efficiency is perhaps the most important property of cigarette filter means, other properties must also be considered, including pressure drop, taste, hardness, appearance and cost. It is necessary to produce a filter which satisfies commercial requirements in each of these areas. Frequently, it is necessary to compromise certain properties in order to satisfy the need for others. For example, the most commonly utilized cellulose acetate filter means has a relatively low filtration efficiency since increased efficiency can only be obtained either by increasing the density of the filter material or the length of the filter element, both of which produce a pressure drop across the filter which is excessive and unacceptable from a commercial standpoint. While various suggestions have been made for the production of filter means which have improved filtering properties, most prior art developments have not been commercially acceptable either because the resulting filter means have been found to have objectionable "taste" characteristics whereby cigarettes provided with such filtering means fail to satisfy a large segment of the smoking public, or because the techniques and/or the materials utilized in the production of such filter means have increased the cost excessively.

High filtration efficiency is considered by the industry to be removal of 60 percent or more of total particulate matter. Cigarette filters having such properties are presently being produced in accordance with the teachings of U.S. Pat. Nos. 3,533,416, 3,599,646, 3,637,447, 3,648,711, 3,805,801 and 3,810,477, all of which are commonly assigned with the instant application. The disclosures of these prior art patents are incorporated herein in their entirety by reference.

A further development in the production of tobacco smoke filter means is disclosed in commonly assigned U.S. Pat. No. 3,811,451, the entire disclosure of which is also incorporated herein by reference.

However, it would be commercially desirable to be able to produce a tobacco smoke filter means having high filtration efficiency, low pressure drop and other satisfactory commercial properties, in a manner which enables the speed of production to be increased, thereby lowering the cost. It is this area with which the instant invention is concerned.

Therefore, it is a primary object of this invention to provide a cigarette filter means or the like and a method and means for manufacturing same wherein the product has high filtration efficiency, satisfactory pressure drop and other commercial requirements, and wherein the method and means utilized enable high speed production of the final product.

A further object of this invention is the provision of a cigarette filter having an inner member with both inner and outer cavities to improve the flow path of tobacco smoke and enable greater utility of the filtering material from which it is made, while simultaneously permitting a conventional plug wrap to be used as an outer member which is substantially continuously supported throughout its length by the inner member so as to avoid the need for an internal glue line as has been required by certain prior art techniques.

The foregoing object is realized by the production of cavity means between the inner and outer members of the filter element which are limited in extent so as to provide a major portion of the outer surface of the inner member which is substantially smooth and basically cylindrical to thereby support the outer member in a uniform manner.

Yet another object of this invention is the provision of methods and means for producing a filter element of the type described wherein the outer cavity may be produced in a high speed fashion with equipment that is simple and inexpensive to manufacture and maintain thereby minimizing production costs.

Still another object of this invention is the provision of techniques and devices for practicing such techniques which enable the outer surface of the inner member to be provided with limited cavities in any number of a variety of patterns, all of which satisfy the basic requirement that the major portion of the outer surface of the inner member be relatively smooth and continuous to uniformly support the outer member of the assembly.

Other and further objects of this invention reside in the chemical and physical characteristics of the filter product, as well as the manipulative steps utilized in the production and the various features of construction found in the manufacturing apparatus. Still other objects will in part be obvious and in part be pointed out as the description of the invention proceeds, and as will be seen from the accompanying drawings, wherein:

FIG. 5 is an enlarged cross-sectional view through one mechanism for forming elongated grooves in the outer surface of the inner filter member according to this invention;

FIG. 6 is a transverse cross-sectional view taken substantially along lines 6—6 of FIG. 5;

FIG. 10 is a sectional view through a portion of the processing apparatus which produces an elongated rod with discrete internal cavities, an alternate position of the reciprocating mandrel used therewith being shown in dotted lines;

FIG. 11 is a view similar to FIG. 1 through a filtered cigarette according to a second embodiment of this invention wherein the outer cavity means of the inner member has a knurled-like configuration;

FIG. 12 is a longitudinal view, partially in section, of a filter rod incorporating filter elements of the type shown in FIG. 11;

FIG. 13 is an enlarged schematic view of a portion of the knurled-like surface of the filter element shown in FIG. 11;

FIG. 16 is an enlarged fragmentary view of a crimping wheel useful in producing a filter element of the type shown in FIG. 1;

FIG. 17 is a schematic fragmentary cross-sectional view showing the manner in which a multiplicity of crimping wheels of the type shown in FIG. 16 would be used in the production of a filter rod;

FIG. 18 is a view similar to FIG. 16 of a portion of a crimping wheel useful in the production of a filter element of the type shown in FIG. 11;

FIG. 19 is a view similar to FIGS. 16 and 18 of a portion of a crimping wheel useful in the production of a filter element of the type shown in FIG. 14; and FIG. 20 is a view similar to FIG. 1 of yet another embodiment of a filtered cigarette within the scope of this invention.

Like reference characters refer to like parts throughout the several views of the drawings.

Figures 1, 2, 3, 4:
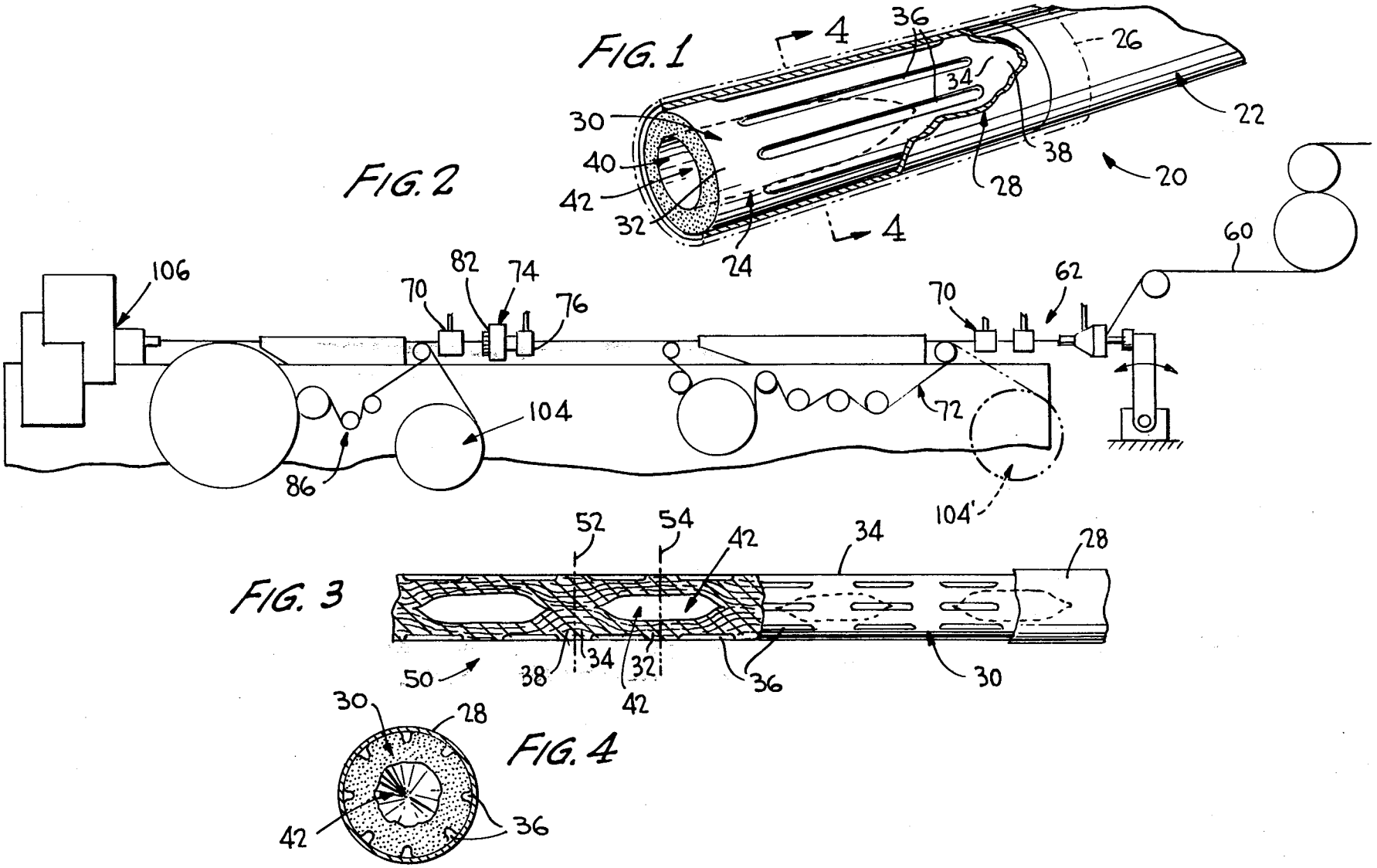
FIG. 1 is an enlarged perspective view of one form of filtered cigarette produced according to the instant invention, parts being broken away for illustrative clarity and convenience.
FIG. 2 is a schematic view of a method and means for making filter elements according to the instant inventive concepts.
FIG. 3 is a fragmentary view of a filter rod produced according to this invention, parts being in section and parts being broken away for illustrative clarity.
FIG. 4 is a transverse cross-sectional view through the filter element of the filtered cigarette of FIG. 1, taken substantially along lines 4—4 of FIG. 1.

Referring now to the drawings, and more particularly to FIG. 1, a filtered cigarette according to the instant inventive concepts is designated generally by the reference numeral 20 and comprises basically a tobacco rod shown partially at 22 and a filter element according to one embodiment of this invention designated generally by the reference numeral 24, a conventional tipping overwrap being shown in dotted lines at 26 securing the tobacco rod and the filter element in end-to-end relationship according to well known prior art techniques.

The filter element 24 comprises basically an axially elongated, hollow, outer element 28 formed by conventional plug wrap as will be explained hereinafter in more detail and an axially elongated inner member 30 disposed within the outer member 28.

The inner member 30 is preferably and primarily formed from a continuous tow of cellulose acetate filamentary material, although other filtering material may be used with slight modifications. For example, filamentary tow formed of other materials such as polyethylene, polypropylene and the like or even nonwoven staple fibers of the type described in some detail in U.S. Pat. Nos. 3,297,041 and 3,552,400, also commonly assigned, the disclosures of which are incorporated herein by reference, may also be used. In fact, it is possible to produce filter elements according to this invention from an extruded, open celled, foam material, such as cellulose acetate foam or the like. However, since cellulose acetate filamentary tow is the presently preferred material from a commercial standpoint, the remainder of this specification will be directed to the use of such material.

Thus, the inner member 30 is preferably formed of crimped filamentary cellulose acetate members bonded together at their contact points to form a smoke-permeable element defining a tortuous path for passage of smoke therethrough. Filtering material of this nature is well known, as are techniques for producing same.

As will be seen from FIGS. 1 and 4, integral circumferentially continuous peripheral portions of the outer surface of the inner member 30 are juxtaposed to portions of the inner surface of the outer member 28 to at least substantially preclude axial passage of smoke across the area therebetween. Such an arrangement is shown at both ends of the inner and outer members in the embodiment of FIG. 1, since the grooves to be discussed in more detail hereinafter terminate short of the ends of this element. However, it is to be understood that the instant invention covers an arrangement wherein the grooves to be discussed further hereinafter extend to the end of the filter element opposite from the inner cavity, also to be discussed in more detail hereinafter.

According to a basic feature of this invention, limited portions of the remaining outer surface of the inner member 30, excluding the continuous peripheral portions 32, 34, are spaced from the inner surface of the outer member 28 to define outer cavity means therebetween which offer less resistance to passage of smoke than the filtering material of the inner member, as well as the areas at which the outer surface of the inner member and the inner surface of the outer member are juxtaposed. In the embodiment of FIGS. 1, 3 and 4, these limited portions are shown as axially elongated, circumferentially spaced, grooves 36 which together define the outer cavity means of the inner member 30.

It should be understood that these grooves have been exaggerated in the drawings for illustrative clarity and that they are, in fact, preferably substantially smaller in circumferential extent than the illustrated embodiments. Moreover, although 8 grooves have been shown, any number of external grooves may be utilized so long as the remaining requirements of this invention are maintained. In fact, a preferred embodiment of this invention utilizes 16 such grooves as will be described subsequently.

A critical feature of this invention resides in the fact that the major portion of the total outer surface of the inner member 30, including the peripheral portions 32, 34, is juxtaposed to the inner surface of the outer member 28 to provide substantially uniform support to the outer member 28 by the inner member 30 throughout its length. Thus, the outer cavity means must be limited in nature such that the remaining outer surface of the inner member 30 is substantially smooth and continuous. For example, the outer cavity means can comprise from about 5 to no more than 50 percent of the total outer surface of the inner member 30 without departing from the instant inventive concepts, with a proportion of 20 to 30 percent being considered optimum.

By thus providing substantially uniform continuous support for the outer member 28 over its entire length it is possible to use a lighter weight plug wrap for the outer member 28 than is required when substantially greater portions of the inner member are spaced from the outer member as, for example, in a filter of the type shown in U.S. Pat. No. 3,533,416. Moreover, this substantially uniform support precludes the need for an internal glue line between the inner and outer members as has been necessary with prior art techniques. Additionally, by avoiding significant crimping of the inner member according to the instant invention, substantially more of the filtering material is available to perform its primary function, that is, removal of undesirable constituents from the tobacco smoke passing therethrough. Yet, the provision of the limited outer cavity means enables the passage of smoke to be directed uniformly over all of the filtering material of the inner member, thereby further improving filtration efficiency.

Referring again to FIG. 1, integral first portions of the inner member 30 extend transversely across the full diameter of the inner member 30 in the form of an uncrimped plug 38 of filtering material defining a tortuous path for smoke therethrough. Integral second portions 40 of the inner member 30 which are axially spaced from the first portions 38, define an area extending across the interior of the inner member 30 which offers less resistance to passage of smoke than the filtering material, as well as the areas at which the outer surface of the inner member and the inner surface of the outer member are juxtaposed, in the embodiment shown this second area being merely the opening at the end of the inner cavity means 42 between the first and second portions 38, 40, respectively. This inner cavity means 42 offers less resistance to passage of smoke than the filtering material of the inner member 30.

Thus, the path of travel of smoke from the tobacco rod 22 is through the plug section 38 into the grooves 36 which distribute the smoke uniformly over the surface of the inner member for passage through the filtering material into the inner cavity means 42 to the mouth of the user.

Of course, it is possible to reverse the filter element 24 in the filtered cigarette 20 so that the area 40 is juxtaposed to the tobacco section 22, rather than the area 38.

In FIG. 3 a continuous rod 50 made up of a multiplicity of integrally connected filter elements of the type shown at 24 in FIG. 1 will be seen. This rod is severed transversely along the lines 52, 54, to produce individual filter elements such as shown at 24. Of course, the rod could be severed at other locations to produce filter elements of multiple length. Moreover, it is common practice to initially produce double filters which are then secured to two tobacco sections by a common tipping overwrap following which individual filtered cigarettes are formed by severing the double filter at its midpoint.

Reference is now made particularly to FIG. 2 for the overall method and means utilized in producing filter elements in accordance with this invention. Basically, this overall technique is similar in many respects to the techniques shown and described in detail in U.S. Pat. No. 3,637,447, referred to previously, while other modifications are similar to specific elements shown in detail in U.S. Pat. No. 3,811,451, also referred to previously. According to preferred embodiments of this invention, the filtering material utilized in production of filter elements is a continuous filamentary tow, designated generally by the reference numeral 60 which includes a multiplicity of bondable fibrous members activated by contact with a hot fluid such as steam. The filtering material 60 is continuously passed into and through an elongated bonding zone 62 which may comprise a conventional stuffer jet and steam head similar in nature to those shown in various of the above-mentioned prior art patents. Specifally, the tow is contacted with steam entering through conduit 64, shown in detail in FIG. 10, and is then distributed through a multiplicity of circumferentially spaced passageways 66 into the bonding zone as the filtering material 60 passes therethrough. A mandrel 68 is positioned generally axially of the bonding zone to define an annular space through which the filtering material 60 must pass and the mandrel 68 is reciprocated between the full line position and the dotted line position in timed relationship to the passage of the filtering material, the dotted position being at least as far forward in the path of travel of the filtering material as the point at which the filtering material is contacted by the bond activating agent, namely steam, to thereby produce a smoke-permeable annular wall of bonded fibrous members as the filtering material passes this point, with the full line position of the mandrel 68 being sufficiently rearwardly of the point in the path of travel of the filtering material at which the steam contacts same to permit a portion of the filtering material to extend transversely completely across the bonding zone before reaching this point, thereby producing a smoke-permeable plug section of bonded fibrous members as the filtering material passes this point. The annular wall and the plug sections are integral with each other to provide the rod 50 with intermittent inner cavity means 42 totally enclosed and surrounded by the annular wall and by plug sections forwardly and rearwardly thereof, as will be seen particularly in FIG. 3.

Following the steam treatment, the rod is cooled at 70, the garniture 72 providing a continuous pulling mechanism drawing the rod through the initial processing stages.

The outer cavity means 36 may be formed in the rod 50 by a variety of techniques and devices, one of which is shown broadly at 74 in FIG. 2 and illustrated in detail in FIGS. 5 and 6. Specifically, this mechanical ironing device 74 includes a steam head portion 76 wherein steam enters through conduit 78 and is distributed by circumferentially spaced passageways 80 to contact and soften the outer surface of the rod 50 as it passes therethrough. The remaining portion 82 of the device 74 comprises forming means for intermittently projecting a plurality of radially extending, circumferentially spaced, pins 84 into contact with the rod 50 as it is continuously moved past said pins by the additional garniture means 86. In this embodiment, a guide member 88 forms an axial bore 90 for passage of the rod 50 and supports the pins 84 in radial extending passageways which each have an enlarged section slidingly carrying cam followers 92 each of which carries one of the pins 84. The cam followers 92 are biased outwardly by spring means 94 to engage a cam surface of a cam ring 96, which cam surface includes first portions 98 for pressing the pins 84 radially inwardly to project the ends thereof into the bore 90 and alternating second portions 100 which permit the pins 84 to move radially outwardly so that their ends are withdrawn from the bore 90. Any conventional means, such as the gear teeth 102, may be provided for rotating the cam ring 96 as shown by the arrow in FIG. 6, so that the first and second portions 98, 100 alternately engage the cam followers 92.

Of course, the cam surface is designed so as to form the grooves 36 over only a limited portion of the outer surface of the rod as it passes through the device 74. For example, a presently preferred embodiment utilizes 16 equally spaced pins each having a diameter of 1/32 inch which, due to the inherent resiliency of the material of the inner member actually produce grooves having a circumferential extend or width of only about 0.020 inch. The groove can have any radial extent or depth, short of engaging the inner cavity 42 although shallow grooves, e.g., approximately 0.020 inch, are fully satisfactory. The axial extent or length of the grooves in the preferred embodiment is approximately two-thirds of the total axial extent of the inner member, terminating equidistant from each end of the inner member.

As an example of how limited the outer cavity may be in order to provide a substantially smooth outer surface while still assisting in distribution of the smoke over the entire filtering material, the grooves may even be formed from a plurality of circumferentially spaced radially extending, razor blades. Thus, only a limited break in the sealed peripheral areas is necessary to improve overall use of the filtration material.

Turning again to FIG. 2, once the outer cavity means 36 have been formed, the rod 50 is overwrapped in the garniture means 86 with a conventional plug wrap, a source of which is shown at 104.

Finally, the rod is severed transversly at selected locations in a cutting means shown schematically at 106.

Figure 7:
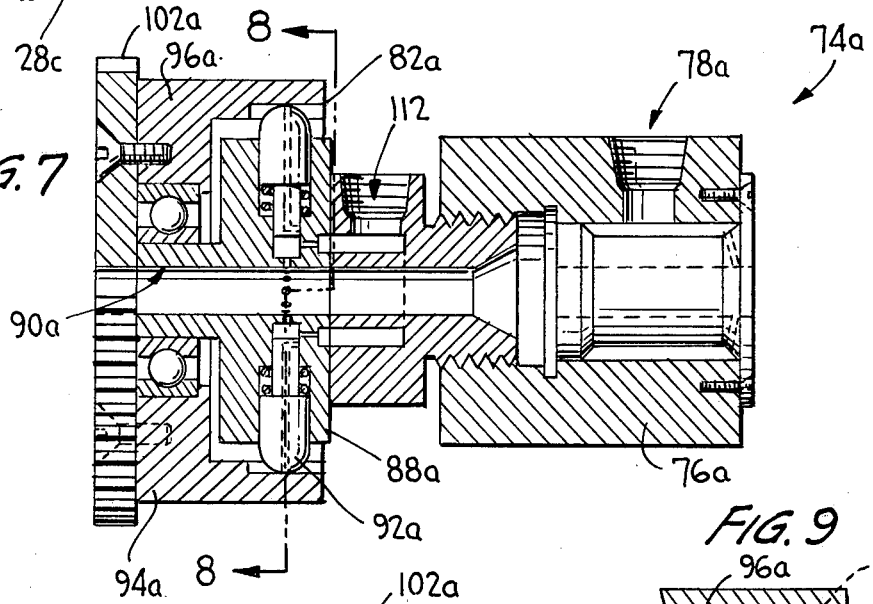
FIG. 7 is a cross-sectional view, similar to FIG. 6, through a means for forming the grooves in the inner filter member by intermittent jets of steam.
Figure 8:
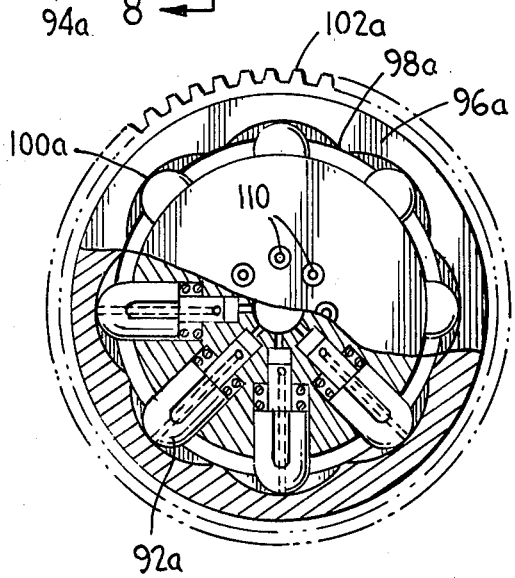
FIG. 8 is a transverse cross-sectional view taken substantially along lines 8—8 of FIG. 7, partially broken away for illustrative clarity.
Figure 9:
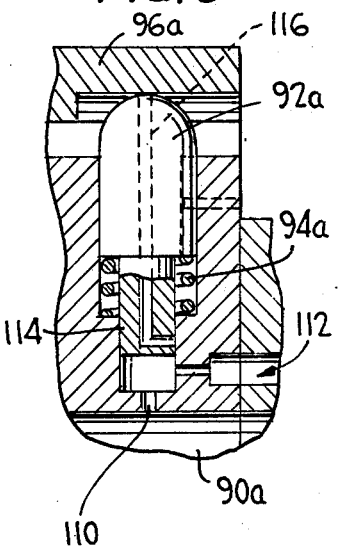
FIG. 9 is an enlarged fragmentary detail showing the valve mechanism in the device of FIGS. 7 and 8.

An alternate technique for defining the grooves 36 is by intermittently projecting jets of steam into contact with the outer surface of the rod 50 as it is moved past such jets. A mechanism for forming the grooves 36 in this manner is seen particularly in FIGS. 7–9, this arrangement being similar to the mechanism shown in FIGS. 5 and 6, like parts being designated by the same reference numeral followed by the suffix "*a*" to facilitate an understanding of this device. The guide means **88*a* includes portions defining a plurality of radially extending, circumferentially spaced, passageways 110 communicating with the bore 90*a*. Steam is fed through a conduit 112 to the passageways 110, with the cam followers 92*a* carrying valve means 114 at their radially inward ends. The valve means comprise vents 116 which in their radially inward position communicate with the conduit 112 and vent the steam to the atmosphere whereas, in the radially outward position of the valve means 114 shown in FIG. 9, the conduit 112 is in communication with the passageways 110 so that jets of steam are intermittently projected into the bore 90*a*. The remainder of this device functions in a manner similar to the device of FIGS. 5 and 6.**

In addition to either of the techniques shown previously for forming the external grooves 36, crimping wheels similar to those shown in FIGS. 10–13 of U.S. Pat. No. 3,637,447 may be used. A portion of one such crimping wheel is shown in FIG. 16 at 120 and will be seen to comprise crimping portions 122 having raised projections 124 corresponding to the grooves 36 with intermittent recessed portions 126 which function to form the uncrimped peripheral portions 32, 34 of the individual filter elements. A multiplicity of such crimping wheels may be used in combination as shown in FIG. 17 to simultaneously form all of the grooves around the peripheral surface of the rod 50 as they engage the rod.

A modified form of filtered cigarette and filter rod according to the instant inventive concepts is shown in FIGS. 11–13. Except for the external cavity means, this embodiment is substantially identical with the embodiment of FIGS. 1, 3 and 4 and, therefore, similar parts have been designated by the same reference numeral followed by a suffix "*b*." In this embodiment the outer cavity means **36*b* is defined by a plurality of interconnecting axially and circumferentially extending outer cavities defining a knurled-like outer surface shown in detail in FIG. 13. Of course, it is important that the knurled-like portion be so defined that a major part of the outer surface of the inner member 30*b* be in contact with, and support, the inner surface of the outer member 28*b*.**

This knurled-like surface may be formed in any conventional manner such as, by the use of crimping wheels, a portion of one of which is illustratively shown at 130 in FIG. 18. Alternately, vacuum means may be utilized to pull portions of the outer surface of the inner member **30*b*** radially outwardly leaving the remaining surface portions to form the outer cavity in a knurled-like pattern.

Figure 15:
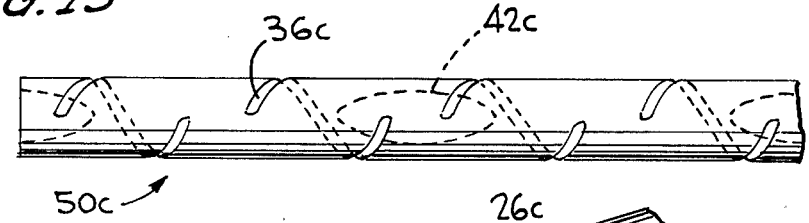
FIG. 15 is a fractional elevational view of a filter rod from which filter elements as shown in FIG. 14 are produced.
Figure 14:
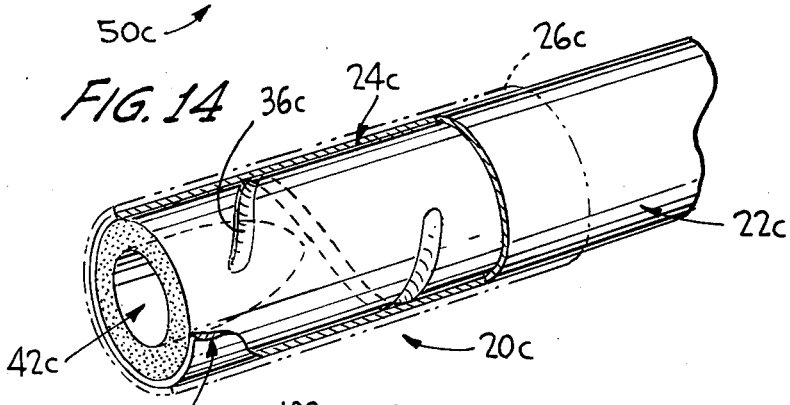
FIG. 14 is a perspective view, similar to FIGS. 1 and 11, of a still further modified filtered cigarette including a filter element according to this invention wherein the outer cavity means is in the form of a continuous helical groove.

Similarly, a further embodiment of the instant inventive concept is shown in FIGS. 14 and 15, wherein parts similar to those of the embodiment of FIGS. 1, 3 and 4 are designated by the same reference numeral followed by a suffix "*c*." It will be seen from FIGS. 14 and 15 that the outer cavity means **36*c*** are in the form of a continuous helical groove.

This helical groove can be formed in any conventional manner, such as, for example, by a multiplicity of crimping wheels, a portion of one of which is shown illustratively at 140 in FIG. 19.

Other patterns for the outer cavity means will be readily recognized by those with ordinary skill in the art, as will techniques and devices for producing same.

Although the outer cavity means can be formed by a crimping technique, it will be seen that crimping of this nature is not as extensive as with the production of prior art filter devices such as those shown in the various above-identified patents. With a substantial crimping of the filter rod, the rod is frequently distorted requiring the use of a relatively heavyweight plug wrap to force it back into its round shape. The use of such heavier material, of course, increases the cost. Moreover, substantial crimping of the filter elements renders the crimped portions relatively useless as a filtering medium, thereby reducing the overall efficiency of the final product.

The following data compares certain characteristics of products made according to the instant inventive concepts designated as "I" and "II" with products according to prior art techniques, a single filter element of the type shown, for example, in U.S. Pat. No. 3,637,447 being designated at "III" and a double filter element of the type shown in U.S. Pat. No. 3,805,801 being designated as "IV" in the table below

| Type | Weight | Pressure Drop | Percent Retention |
|---|---|---|---|
| I | 11.5 gms | 2.7" | 71.8 |
| II | 11.7 gms | 2.8" | 70.8 |
| III | 16.5 gms | 2.8" | 69 |
| IV | 13.4 gms | 2.8" | 65 |

It will be seen from the above that filter elements prepared according to the instant inventive concepts compare favorably with the prior art filters with respect to pressure drop, while providing at least as good as, and frequently better, filtration efficiency with less material. Other commercially significant properties such as hardness, taste and the like also compare favorably with prior art filter elements.

Although the outer member 28 in the various embodiments described hereinabove has been the plug wrap and the inner member 30 has been formed entirely of a filtration material such as cellulose acetate tow or the like, a further possible modificaton within the instant inventive concepts utilizes the plug wrap as a part of the filtration material. Reference is made to FIG. 20 wherein such an embodiment is shown with parts similar to previous embodiments bearing the same reference numeral followed by a suffix "*d*."

Porous or smoke-permeable plug wraps are well known and are commercially available under various trade designations, e.g., Ecusta Ref. No. 29612 or Schweitzer Ref. No. 638-63-1. When using a material of this type it is possible to overwrap the cellulose acetate rod with porous plug wrap prior to forming the outer cavity means. Thus, if desired, in a system such as the one shown in FIG. 2, the porous plug wrap may be secured about the cellulose acetate rod in the garniture means 72 as shown in dotted lines at 104' rather than in the garniture means 86 as shown in full lines at 104. Then, outer cavity means such as a plurality of circumferentially spaced, axially extending grooves **36*d* may be formed such as by crimping wheels or the like in the outer surface of this composite inner member, that is, the cellulose acetate rod 24*d* covered with porous plug wrap 28*d*. Preferably such grooves would extend completely over the plug sections 34*d* of the cellulose acetate rod and terminate short of the midsections of the inner cavity means 42*d*. With an "inner member" of this type, the tipping overwrap 26*d* used to join the filter section to the tobacco section functions as the "outer member" of the filter element 20*d***. Thus, the use of the terms inner member and outer member herein and in the appended claims is to be understood as being broad enough to include an arrangement wherein the inner member is a composite element including a porous plug wrap and the outer member is the tipping overwrap. With such a construction the smoke passes through the inner and outer cavity means, as well as the porous plug wrap and the cellulose acetate filtration material of the inner member affording even further filtration resulting from the presence of the plug wrap in the smoke path.

It will now be seen that there is herein provided a smoke filter and method and means for manufacturing same which satisfies the various objectives set forth previously, and which provide significant advantages of a commercial nature. While this invention has been described with reference to presently preferred exemplary embodiments thereof, it should be clearly understood that the invention is not limited thereto, but may be variously practiced within the scope of the following claims.

The embodiments of the invention in which an exclusive property or privilege is claimed are defined as follows:

1. A smoke filter means including a filter element comprising:

a. an axially elongated, hollow, outer member;

b. an axially elongated inner member disposed within said outer member;

c. said outer member including an inner surface and having spaced end portions;

d. said inner member comprising a filtering material and including an outer surface and having spaced end portions;

e. integral circumferentially continuous peripheral portions of said outer surface of said inner member being juxtaposed to portions of said inner surface of said outer member at at least one end portion of said inner and outer members to at least substantially preclude axial passage of smoke across the area therebetween;

f. limited portions of the remaining outer surface of said inner member, excluding said peripheral portions, being spaced from said inner surface of said outer member to define outer cavity means therebetween which offer less resistance to passage of smoke than said filtering material and said areas at which said outer surface of said inner member and said inner surface of said outer member are juxtaposed;

g. a major portion of the total outer surface of said inner member, including said peripheral portions, being juxtaposed to said inner surface of said outer member to provide substantially uniform support to said outer member by said inner member throughout its length;

h. integral first portions of said inner member extending transversely substantially completely across said inner member in the form of an uncrimped plug of filtering material offering substantially the same resistance to passage of smoke as other portions of the filtering material of said inner member and defining a tortuous path for smoke therethrough;

i. integral second portions of said inner member axially spaced from said first portions, defining an area extending across the interior of said inner member which offers less resistance to passage of smoke than said filtering material and said areas at which said outer surface of said inner member and said inner surface of said outer member are juxtaposed;

j. integral additional portions of said inner member between said first and second portions defining inner cavity means offering less resistance to passage of smoke than said filtering material and said areas at which said outer surface of said inner member are juxtaposed to said inner surface of said outer member;

k. whereby smoke passing through said filter element must travel through both said cavity means and through said filtering material.

2. A cigarette comprising, in combination, a tobacco rod and a filter means secured in end-to-end relationship to one end of said tobacco rod, said filter means including a filter element as defined in claim 1.

3. A cigarette according to claim 2 wherein said filter means is disposed such that said first portions of said inner member are closer to said tobacco rod than said second portions.

4. A cigarette according to claim 2 wherein said filter means is disposed such that said second portions of said inner member are closer to said tobacco rod than said first portions.

5. A filter rod comprising a multiplicity of filter elements as defined in claim 1 integrally connected together with first portions of alternating filter elements in said rod juxtaposed to each other and second portions of alternating filter elements in said rod juxtaposed to each other.

6. A filter means according to claim 1 wherein said filtering material of said inner member comprises cellulose acetate tow.

7. A filter means according to claim 1 wherein said filtering material of said inner member comprises crimped filamentary tow members bonded together at their contact points to form a smoke-permeable body defining a tortuous path for passage of smoke, and a surrounding layer of smoke-permeable plug wrap, said outer member comprising a portion of a tipping overwrap used for connecting said filter means to a tobacco rod.

8. A filter means according to claim 1 wherein said limited portions of said remaining outer surface of said inner member which define said outer cavity means comprises about 5 to no more than 50 percent of the total outer surface of said inner member.

9. A filter means according to claim 8 wherein said limited portions comprise between about 20 and 30 percent of the total outer surface of said inner member.

10. A filter means according to claim 1 wherein said outer cavity means comprises a plurality of axially extending, circumferentially spaced, individual outer cavities.

11. A filter means according to claim 10 wherein each of said outer cavities terminates in spaced relationship to both ends of said inner member.

12. A filter means according to claim 1 wherein said outer cavity means comprises a plurality of interconnecting axially and circumferentially extending outer cavities defining a knurled-like outer surface over a major portion of said inner member.

13. A filter means according to claim 12 wherein said knurled-like portion of said outer surface of said inner member terminates in spaced relationship to both ends of said inner member.

14. A filter means according to claim 1 wherein said outer cavity means comprises a continuous helical groove.

15. A filter means according to claim 14 wherein the ends of said helical groove terminate in spaced relationship to said ends of said inner members.

* * * * *